US005901395A

United States Patent [19]

Vander Heiden et al.

[11] Patent Number: 5,901,395

[45] Date of Patent: May 11, 1999

[54] MODULAR THRESHOLD RAMP

[76] Inventors: Timothy J. Vander Heiden, 1712 Broadway, Chico, Calif. 95928; Homer L. Duerr, 3291 Grape Way, Chico, Calif. 95973

[21] Appl. No.: 08/927,074

[22] Filed: Sep. 11, 1997

[51] Int. Cl.[6] ..... E01D 1/00

[52] U.S. Cl. ..... 14/69.5; 34/32

[58] Field of Search ..... 14/69.5; 254/88; D34/32

[56] References Cited

U.S. PATENT DOCUMENTS

D. 346,256 4/1994 Thomas, III et al. ..... D34/32

D. 353,071 12/1994 Roberts ..... D34/32 X

*Primary Examiner*—James A. Lisehora

*Attorney, Agent, or Firm*—John P. O'Banion

[57] ABSTRACT

A low pitched, wedge-shaped ramp has flanges on two sides and to provide easy access for a wheeled device such as a wheelchair, the ramp has a flattened frontal edge. An upwardly angled top surface has indented tread squares across a major portion for wheel position frictional maintenance. The ramp is manufactured of recycled rubber for strength and light weight and can be moved easily from place to place. Designed for door threshold use, the underside of the ramp has a framed indentation for restricting ramp slippage.

6 Claims, 1 Drawing Sheet

MODULAR THRESHOLD RAMP

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains to portable ramps, and more particularly to a low pitch ramp for placement against the vertical wall of a riser between two levels of flooring so that a wheelchair device can be reversibly moved from one level to the other, such as a wheelchair being moved from a sidewalk entrance over a door threshold.

2. Description of the Background Art

Although various ramps useful for moving wheelchairs, hand-trucks, and other wheeled carriers between floor levels are seen in prior art patents and in the market place, there appeared to be no direct similarity between other ramps seen and ramp of the present invention.

BRIEF SUMMARY OF THE INVENTION

The present invention is particularly directed towards a low pitch ramp having flanged edges on three sides for easy wheel access and an angled top surface with centered indented tread squares for wheel position frictional maintenance. For strength, light weight and environmental protection purposes, the ramp of this invention is structured of recycled rubber. For safety, the underside of this ramp is structured to restrict and prevent ramp movement in application. Therefore, in practicing our invention, we provide a light weight, wedge shaped, modular threshold ramp manufactured of recycled rubber designed as a low pitch transition piece to be placed against a door threshold. The top slanted surface of our riser has indented tread squares crosswise in a major center section. The tread squares help prevent rubber tired wheels of wheelchairs and the like from slipping as the wheels access from the substrate to the level landing. A lower end flanged edge allows easy wheel access to the ramp and the underside is grooved to create a rubberized base pad frame to prevent ramp slippage, the rubberized material being the recycled material from which the invention is manufactured. The device of this invention can be moved easily from place to place as needed.

As a principal object, the present invention provides a modular, light-weight ramp for use against a door threshold.

Another object of the invention is to provide a highly portable low pitch ramp that can be easily moved from place to place as needed.

A further object of our invention is to provide a modular threshold ramp with indented tread squares in a top surface that helps maintain wheel position on the top surface and a grooved bottom surface to restrict ramp slippage.

A still further object of the invention is to provide a modular threshold ramp manufactured of recycled rubber for environmental protection purposes.

Further objects and advantages of the present invention will be brought out in the following portions of the specification, wherein the detailed description is for the purpose of fully disclosing preferred embodiments of the invention without placing limitations thereon.

DETAILED DESCRIPTION OF THE INVENTION

Figure 1:
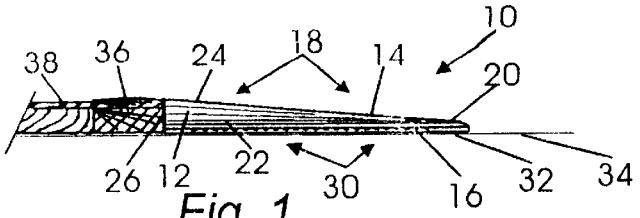
FIG. 1 shows a side elevation view of a modular threshold ramp in accordance with the invention.

Referring now to FIG. 1, a side elevational view of a low pitch ramp apparatus in accordance with the invention 10 is generally shown. The illustrated parts included parts include a modular threshold ramp 12, referred hereinafter as ramp 12, having a top surface 14 and a bottom surface 16. Top surface 14 rises at a low pitch upward from a flattened front edge 20 to a vertical back wall 26. Centered crosswise in upper surface 14 is an elongated rectangle fitted with indented tread squares 18. At the top of squares 18 is a shoulder 24. At the side ends, where indented tread squares 18 terminate, ramp 12 bends downward to form into end flanges 22. On the underside of ramp 12, embedded into the bottom surface 16 is center indentation 30 framed by indent frame 32. Frame 32 is rubberized by the material of the manufacturer (See FIG. 5, recycled rubber 42) and acts like a frictional shape of ramp 12, in position. Ramp 12 is positioned on walk 34 with a vertical back 26 against the vertical front of threshold 36. Ramp 12 has a low pitch, just high enough to allow passage of a wheeled device up over threshold 36 and onto floor section 38.

In using the apparatus 10, modular threshold ramp 12 is positioned against a threshold 36. This allows a wheeled device, a wheelchair for example, to roll up over edge 20 of ramp 12, across indented tread squares 18 (they help prevent reverse wheel roll), up over shoulder 24 and threshold 36 onto floor 38.

Figure 2:
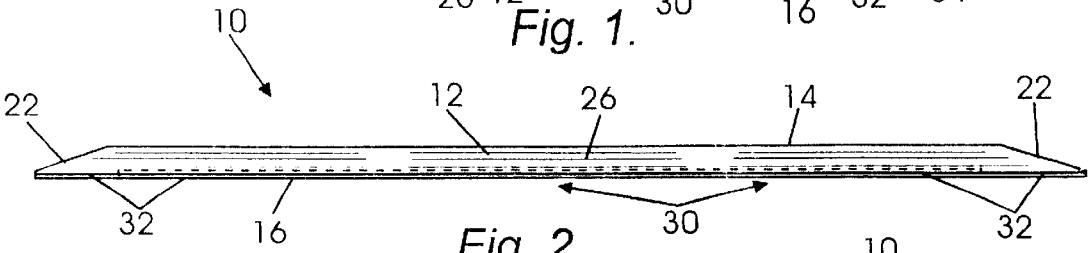
FIG. 2 shows a rear view of the ramp illustrating the vertical rear wall designed to be positioned against the riser area of a door threshold.

FIG. 2 illustrates a rear view of the apparatus 10. Vertical rear wall 26 has each end slanted down to form flanges 22. The positions of top surface 26 with each end slanted down to from flanges 22. The positions of the top surface 14 and bottom surface 16 are indicated. Central indentation 30 aligned by frame 32 is shown in dotted lines. Frame 32 is part of bottom surface 16, and forms a base on which ramp 12 rests.

Figure 3:
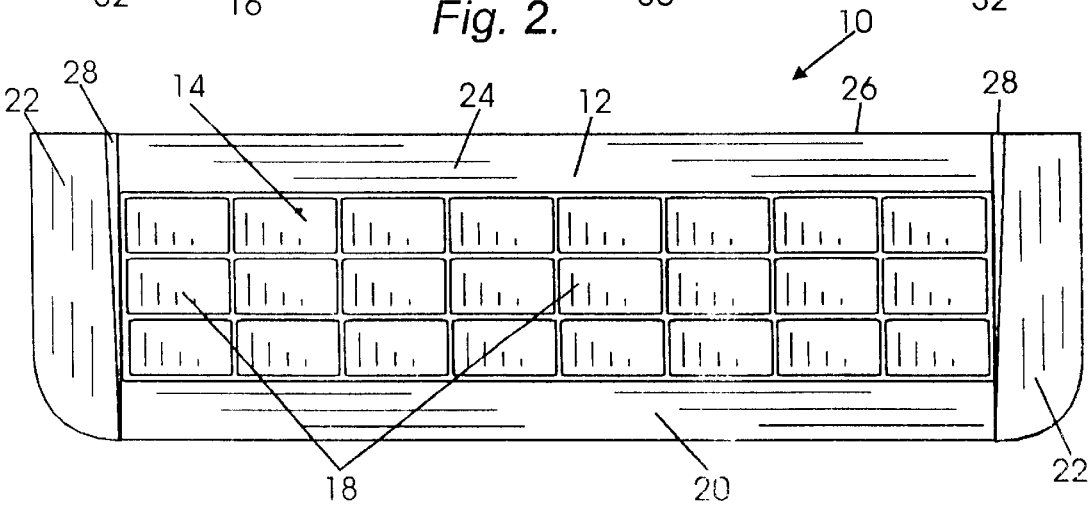
FIG. 3 shows the ramp in a top plan view.

FIG. 3. shows the apparatus 10 in a top plan view. An elongated rectangular center portion of upper surface 14 is arranged with indented tread squares 18. The outer ends of ramp 12 are curved down at curve angles 28 and form end flanges 22. Ramp 12 has a lower front edge 20 flattened for easy wheel device access. Adjacent indented tread squares 18 is shoulder 24. Shoulder 24, end flanges 22, front edge 20 are approximately the same in surface width and form a frame around indented tread squares 18. Tread squares 18 help prevent wheel roll when ramp 12 is in use.

Figure 4:
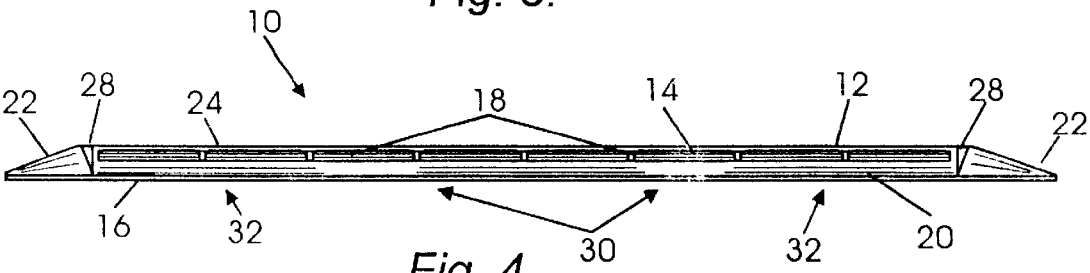
FIG. 4 shows the ramp in a frontal view.

FIG. 4 shows the apparatus 10 in a frontal view illustrating flattened front edge 20 for easy wheel access onto ramp 12. Indented tread squares 18 are seen centered crosswise in upper ramp surface 14. The position of lower surface indent 30 is indicated by arrows as is the base frame 32, a part bottom surface 16. Each end of ramp 12 angles downward at angled sections 28 to form into flanges 22.

Figure 5:
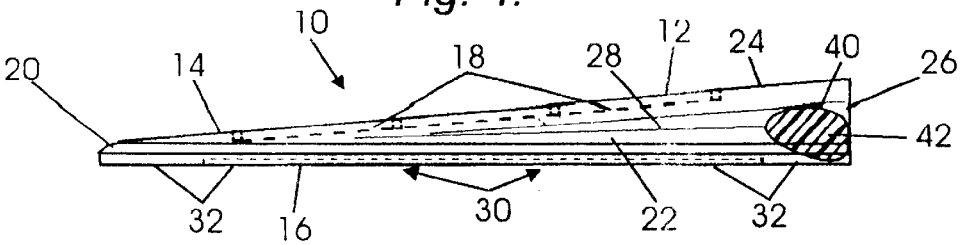
FIG. 5 shows the ramp in an enlarged elevation view illustrating the opposite side from which the ramp is shown in FIG. 1, with a portion cut away.

In FIG. 5, the apparatus 10 is shown with ramp 12 in an enlarged elevation view. A section 40 at the right rear of the ramp 12 is opened to illustrate the recycled rubber 42 from which ramp 12 is manufactured, making it light weight and easy to move to places where it might be needed. Indented tread squares 18 in top ramp surface 14 are indented by dotted lines as is the opened area in bottom surface 16 to show indent 30 bounded by frame 32.

Although the description above contain many specificities, these should not be construed as limiting the scope of the invention but merely as providing illustrations of the presently preferred embodiment of this invention. Thus, the scope of this invention should be determined by the appended claims and their legal equivalents.

What is claimed is:

1. A modular threshold ramp structure, comprising:

(a) a wedge-shaped elongated rectangular ramp, said ramp having a top surface, said ramp having a bottom surface, said top surface converging with said bottom surface along a first longitudinal edge of said ramp to form a flattened frontal edge, from said frontal edge said top surface angling away from said bottom surface to a widened area along a second longitudinal edge of said ramp, said widened area being a vertical wall of said ramp structure separating said top surface from said bottom surface a measured distance producing said wedge shape in said ramp structure, said ramp structure having extensions of said top surface, materials thereof, angled downward at two latitudinal ends converging with like extensions of said bottom surface, materials thereof, forming flanges with straight edges rounded at one end;

(b) a multiple of indented grouped tread squares aligned longitudinally in a major portion of said top surface of said ramp;

(c) a shoulder extended longitudinally along said longitudinally aligned tread squares as part of said top surface, said shoulder positioned between said aligned tread squares and said widened area along said second longitudinal edge of said ramp; and (d) a frame defining a framed indentation in said bottom surface of said ramp, said frame being part of said bottom surface, said frame being resting support for said ramp, said indentation providing flex in said structure causing seating to reduce slippage of said ramp from a set position.

2. The modular threshold ramp structure of claim 1 wherein said ramp is manufactured of a materials comprising recycled rubber.

3. The modular threshold ramp structure of claim 1 wherein said indented grouped tread squares are of sufficient depth to provide traction for a tired wheel such as a wheelchair wheel and the like.

4. A modular threshold ramp apparatus, comprising:

(a) a front edge;

(b) a shoulder, said shoulder connected to said front edge by a ramp, said ramp tapering from said shoulder to said front edge, said ramp comprising a first side edge and a second side edge, said ramp comprising a plurality of indented tread squares;

(c) a first and second flange, said first flange located adjacent said first side edge of said ramp, said second flange located adjacent said second side edge of said ramp;

(d) a back wall, said back wall extending downward from said shoulder; and (e) a bottom surface, said bottom surface located below said ramp and between said first and second flange, said bottom surface comprising a frame indentation, said frame indentation providing flex to said apparatus when a weight is applied to said front edge, said ramp, said shoulder or said flanges.

5. An apparatus as recited in claim 4, said ramp comprising a top surface wherein said plurality of indented tread squares are aligned longitudinally on said top surface.

6. An apparatus as recited in claim 4, said flanges each comprising an inner section and an outer section, said inner section located adjacent said edges of said ramp, said outer section tapering downwards.

* * * * *